United States Patent [19]

Davis

[11] 3,931,890

[45] Jan. 13, 1976

[54] STACKABLE LID

[75] Inventor: Paul Davis, Swampscott, Mass.

[73] Assignee: Sweetheart Plastics, Inc., Wilmington, Mass.

[22] Filed: June 27, 1974

[21] Appl. No.: 483,644

[52] U.S. Cl. ..... 206/508; 206/515; 220/380

[51] Int. Cl.[2] ..... B65D 21/02

[58] Field of Search ..... 206/503, 505, 508, 509, 206/511, 515, 519, 520; 220/380; 215/10, 363

[56] References Cited

UNITED STATES PATENTS

| | | | |
|---|---|---|---|
| 1,657,985 | 1/1928 | Wright | 206/515 |
| 1,786,733 | 12/1930 | Benoit | 220/380 |
| 1,931,595 | 10/1933 | Weguelin | 215/363 |
| 1,979,911 | 11/1934 | Steudel | 206/515 |
| 2,496,093 | 1/1950 | Iwata | 215/10 |
| 3,362,575 | 1/1968 | Fotos | 206/508 |
| 3,481,502 | 12/1969 | Slayman | 206/511 |
| 3,701,456 | 10/1972 | Alroy | 206/520 |

*Primary Examiner*—George E. Lowrance

[57] ABSTRACT

A disposable plastic lid for a container includes a generally round closure wall and a depending peripheral skirt for engagement with the container. The closure wall includes an improved stacking facility by which a plurality of such container lids may be stacked one on top of the other in a manner which precludes the stacked lids from being jammed together. The stacking means also retards materially any tendency for the lids in the stack to slip sideways with respect to each other which provides a very stable stack without supplementary supports.

12 Claims, 7 Drawing Figures

FIG. 4
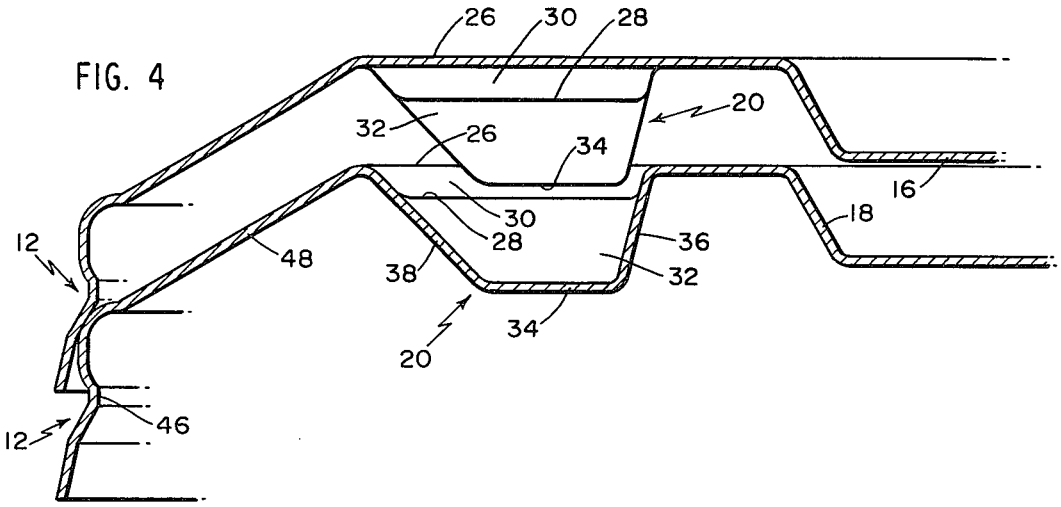
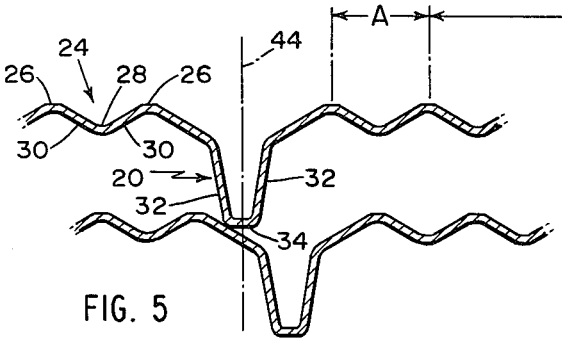
FIG. 5
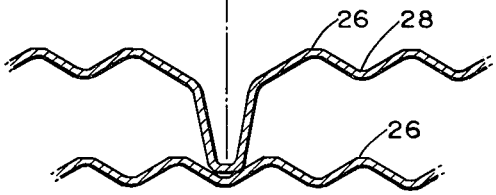
FIG. 5A
FIG. 6
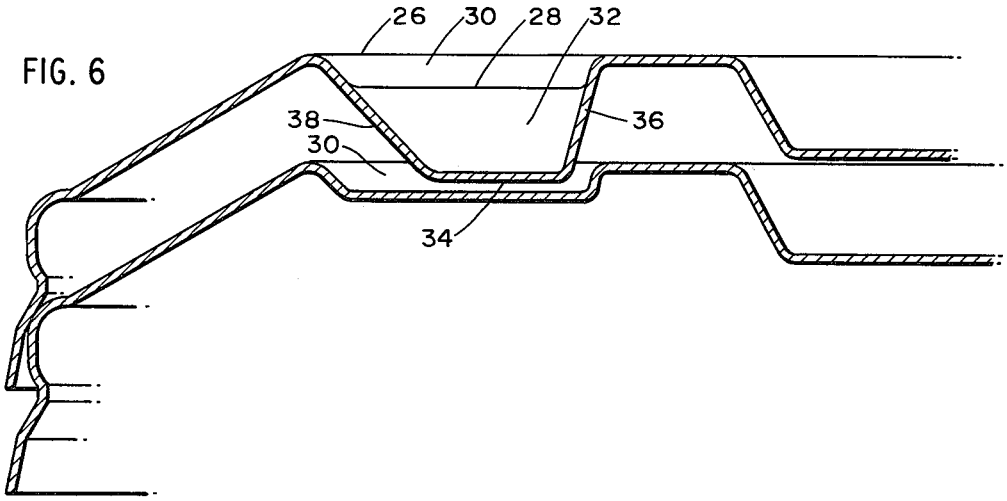

STACKABLE LID

BACKGROUND OF THE INVENTION

This invention relates to disposable, thin-wall, plastic lids and more particularly comprises a new and improved lid having a stacking facility which cooperates with other similar lids to form a very stable lid stack and to prevent jamming when axial loads are applied to them.

Recent years have witnessed the rapid growth of the use of disposable thermoformed plastic container lids, particularly in connection with fast food establishments, vending machines, automatic container filling equipment and the like. Considerable efforts have been directed to the design of such lids to include, as an integral part of the lid, a stacking facility by which a plurality of such lids may be nested one on top of another, in a stack, but in a manner which precludes them from becoming jammed when the stack is subjected to an axially applied load.

The most common type of stacking facility employed in connection with container lids is incorporated into and is made part of the depending peripheral skirt of the lid. Typically, such stacking facility is in the form of an undercut region between the top and bottom of the skirt which defines an inwardly extending stacking ring of slightly reduced diameter, which creates a positive interference with the upper outer peripheral region of the next lower lid in the stack. There are certain disadvantages, however, to undercut stacking rings of that type. For example, the undercuts make it difficult to remove the articles from the mold cavities after they are formed, and special stripping mechanisms frequently are necessary to eject the articles from the cavities. Difficulties are also encountered in actually forming the details of the undercuts, and if the details are not formed well, the articles may jam together when an axial load is applied. In addition, it may be noted that because of the typical thermoforming procedures employed to manufacture such lids, the lid skirts are somewhat thinner than the other portions of the lids and consequently are of reduced rigidity. As a result, the typical undercut stacking ring in the lid skirt does not always perform well in that it may sometimes flex and distort under an axial load and become jammed with the next lower lid in the stack.

The foregoing difficulties have not gone unrecognized and efforts have been made to avoid them. For example, suggestions have been made to provide the lid with a stacking facility in the form of projections extending downwardly from the closure wall of the lid to rest on the upper surface of the closure wall of the next underlying lid in the stack. This type of construction, however, presents other difficulties. For example, the downwardly extending projections may extend into food packaged in the container, which is undesirable.

In addition to the above difficulties the prior art stacking facilities of the general character discussed above do not create a very stable stack. Even though the stacking facilities may tend to prevent axial jamming, they do not dependably maintain the lids in vertical alignment; rather, they permit the lids to slip sideways to create a rather sloppy pile of lids when the lids are not confined in a magazine or some special storage container. This is particularly troublesome when the lids are designed for over-the-counter use in fast food establishments where they are normally placed on a counter without any magazine or storage container about them so as to be readily accessible to those working at the counter.

It is among the primary objects of the invention to provide an improved container lid construction which avoids the foregoing and other difficulties.

SUMMARY OF THE INVENTION

The lid includes a closure wall and depending peripheral skirt which is adapted to fit snugly onto the container rim. The closure wall is formed with a plurality of integral feet which extend away from the closure wall, the feet being arranged in angularly spaced relationship about the center of the closure wall and inwardly from the depending skirt. The opposite side of the lid is formed to define an annular region which will engage the outermost ends of the feet on the next adjacent lid in the stack and in a manner which precludes lateral movement and relative rotation of the stacked lids as well as providing a means to insure that the lids will not become jammed together when subjected to an axial compressive load. The lids preferably are formed in groups in which some of the lids in the group have projections which are of different angular spacing then the projections on other of the lids in the group. Such lids are stacked in alternating sequence which insures that the stacked lids will be mismatched and therefore will not become jammed.

One important object of this invention is to provide a stacking facility particularly designed for thin wall lids, which facility is free of undercuts and which nevertheless maximizes the interference of adjacent lids in a stack to prevent jamming.

Another important object of this invention is to provide a stacking facility particularly useful in lids, which lends great lateral stability to a stack of lids so that the lids may be vertically stacked by themselves in substantial numbers without falling over or bending over in an arcuate, unstable manner.

A further object of the invention is to provide an improved lid construction by which relative lateral shifting or slipping of adjacent lids is precluded by the different angular positions of the stacking facilities in the lid.

A further object of the invention is to provide an improved lid stacking facility of the type employing projections which extend downwardly from the closure wall of the lid but not to an extend which will cause the projections to contact the contents of the container.

A further object of the invention is to provide a lid stacking facility which precludes relative rotation of said lids when stacked.

A further object of the invention is to provide an improved lid stacking facility in which there is no substantial lateral play between stacked lids.

A further object of the invention is to provide an improved lid stacking facility including a plurality of circumferentially spaced feet extending away from the main closure wall of the lid with the feet being disposed in an annular region which also includes radial reinforcing flutes.

DESCRIPTION OF THE DRAWINGS

The foregoing and other objects and advantages of the invention will be appreciated more fully from the following further description, with reference to the accompanying drawings wherein:

FIG. 4 is an enlarged side elevation, in section of the stacked lids as seen from the plane 4—4 of FIG. 1;

FIGS. 5 and 5A are partly sectional, somewhat diagrammatic illustrations of the nested lids of FIG. 1 taken along section lines 5—5 and 5A—5A of FIG. 1 and illustrating the phase relationship of the feet of adjacent stacked lids; and FIG. 6 is an illustration similar to FIG. 4 as seen along the plane 6—6 of FIG. 1.

DESCRIPTION OF THE PREFERRED EMBODIMENT

Figure 1:
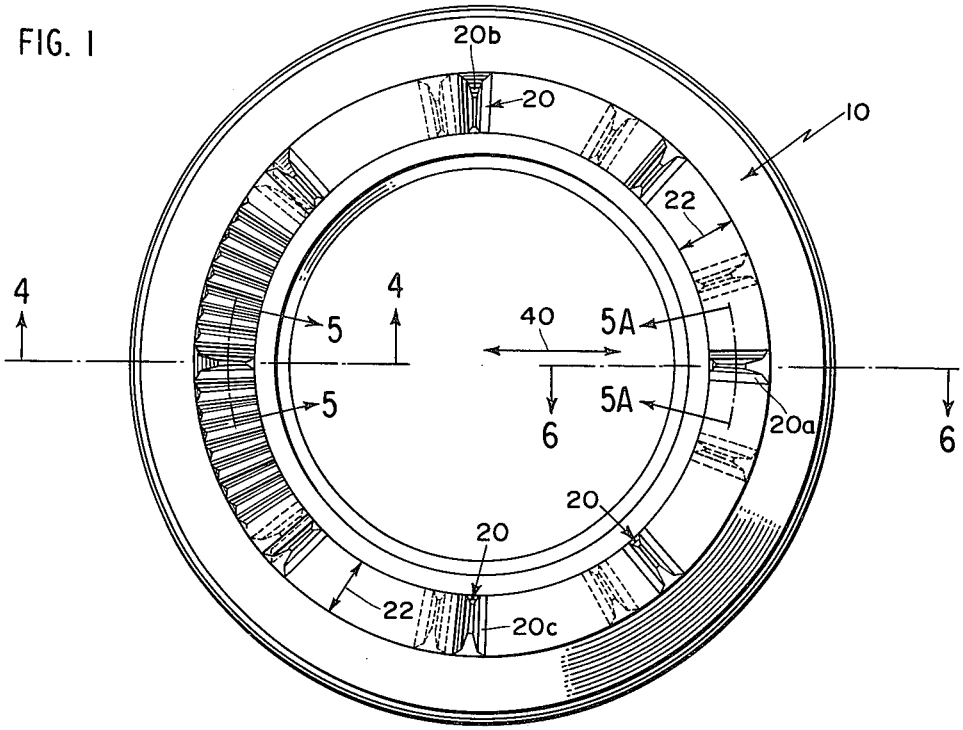
FIG. 1 is a plan view of a pair of container lids embodying the principles of the invention, the lids being stacked and with the bottom underlying lid being illustrated in phantom.
Figure 2:
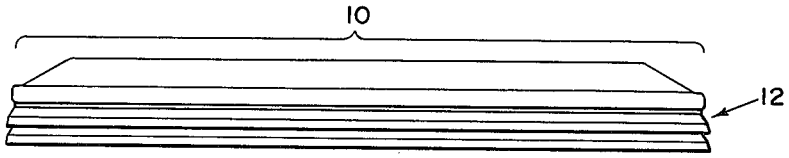
FIG. 2 is a side elevation of the stacked, nested lids shown in FIG. 1.

The lids shown in the drawings are disposable, plastic, thin-walled lids which are designed for manufacture by conventional thermoforming techniques. The lids are particularly designed for one time use and typically may be employed in fast food establishments as cover-all lids for cold drinks or other food products. The lids have particular utility in environments where they are to be stacked with other like lids and placed on a counter top with no special supports so that the lids may be taken freely and individually from the stack as required by those working at the counter.

Figure 3:
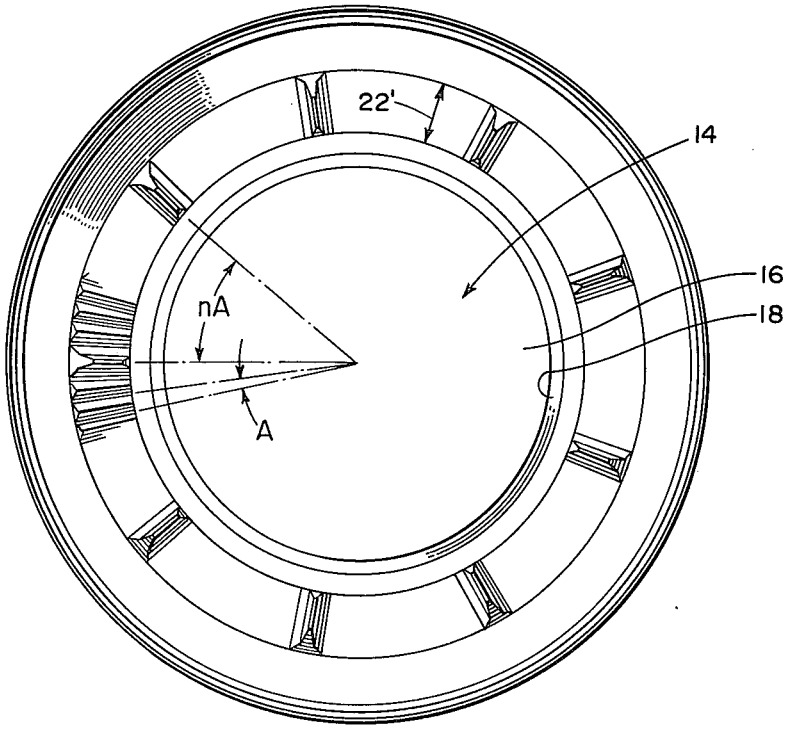
FIG. 3 is a plan illustration of the underlying bottom lid of FIG. 1.

FIGS. 1 and 3 show a pair of cooperative lids constructed in accordance with the invention, the upper lid being shown in solid in FIG. 1 and the lower lid being suggested in phantom. The lower lid of the pair is shown separately in FIG. 3. Except as described otherwise herein the lids are of identical construction. Each lid includes a substantially circular, generally horizontal closure wall 10 of a diameter sufficient to cover the mouth of the container to be closed. A downwardly extending peripheral skirt 12 is formed integrally with the closure wall 10 and is designed to snap over the rim of the paper or plastic container and effect a firm and secure seal. The inner region of the wall 10 may be provided with a circular recess 14 defined by bottom wall 16 and sidewall 18. The recess 14 may be dimensioned to receive the bottom of a container to facilitate stacking of a plurality of filled and capped containers one on top of the other. The formation of recess 14 also enhances the lateral strength and stability of the lid.

The improved nesting facility of the invention includes a plurality of feet, indicated generally at 20 (see also FIGS. 4–6) which are fomed integrally with the closure wall 10. The feet 20 project away from the surface of the closure wall, for example, in a generally downward direction in the embodiment shown. Feet 20 are angularly spaced about the center of the lid and are spaced radially from the lid center so that they lid within a generally annular region 22 of the closure wall 10. Preferably, the annular region 22 is disposed on that portion of the closure wall which lies between the recess 14 and the skirt 12. As will be described more fully below, the depth of the feet 20 is such that when the lids are stacked, the lower ends of the feet will rest on the corresponding annular region 22′ on the underlying lid and in a manner which maintains the desired separation of the adjacent lids.

It may be noted that lids of the type described typically are formed from a single thin sheet of formable plastic and in a thermoforming process in which a projection, such as the feet 20 or recess 14, from one side of the sheet results in a depression on the other side of the sheet. It is therefore desirable to form the adjacent lids so that when the lids are stacked the male projections will be at least partly mismatched with respect to the female depressions on the adjacent lid. To this end, the upper of the lids may be provided with a different number of feet 20 than those of the next lower lid in the stack or while the lids may have the same number of feet their angular spacing may be slightly different. A group of mismatching lids may be formed simultaneously by employing generally conventional thermoforming techniques. In this regard it may be noted that the thin walled thermoformed lids typically are formed in a die having a plurality of lid-defining cavities. The configurations of the cavities, with regard to the spacing or number of feet may be varied from cavity to cavity within a single mold. After the thermoformed sheet has been stripped from the die and the lids have been cut from the sheet they are stacked in a sequence in which mismatched lids lie one on top of the other in the stack. For example, as shown in FIGS. 1 and 3, the upper of the lids has eight feet 20 which may be equally spaced and the lower of the lids may have 9 feet which are also equally spaced but at a lesser angle than the spacing between the feet of the upper of the lids. As suggested in FIG. 1 this insures that the feet on the upper and lower of the lids will be mismatched regardless of the relative angular attitude of the adjacent lids. Other configurations may be employed as, for example, providing each of the lids with the same number of feet but varying the angular spacing of the feet from one lid to the next. Thus, each of the lids could have nine feet with the feet on one of the lids being spaced at equal angles but with the feet on the other of the lids being spaced at different angles in a somewhat nonsymmetrical configuration to effect the desired mismatching. It will be appreciated that many varieties of configurations for spacing the feet may be employed to effect the desired mismatching.

In addition to the cooperation between the feet 20 of one lid and the closure wall 10 of the next adjacent lid to preclude axial jamming of the stacked lids, means are provided on the annular region 22, 22′ of each lid for engagement with the outer extremities of the feet on the other lid in a manner which precludes horizontal movement of the feet over the annular region. As shown in the preferred embodiment, the feet engaging means may take the form of a multiplicity of radial flutes 24 circumferentially spaced along the annular region 22. As shown more clearly in FIGS. 4–6 the flutes 24 define alternating peaks 26 and troughs 28 defined by adjacent sidewall portions 30 of the flutes. The flutes 24 are dimensioned with respect to the ends of the feet 20 so that the ends of the feet may seat within the flutes and rest within the trough 28 defined by adjacent flute sidewalls 30. For example, in the illustrated embodiment the feet 20 are downwardly tapered and are be defined by a pair of sidewalls 32, bottom wall 34, and end walls 36, 38. The foot sidewalls 32 are tapered at a more acute angle than that defined by the flute sidewalls 30 which define the troughs 28. The width of the foot bottom wall 34 is selected with respect to the depth of the flute valleys 28 and the angle of the valleys 28 so that the outer ends of the legs may extend well into the valleys without becoming jammed. As will be described, the relationship of the angular spacing between the feet 20 and flutes 24 is such that all or at least most of the feet 20 will rest within a flute valley 28 when one of the lids is placed atop another. The foregoing arrangement is effective to substantially retard horizontal movement of the feet with respect to the flutes which results in a very stable stack of such lids. It may be noted that there is substantially no "play" between the adjacent lids and that the feet and flutes cooperate to resist relative horizontal movement of the adjacent lids.

The manner in which the feet 20 and flutes 24 cooperate to provide a stable stack of lids may be appreciated more fully from FIG. 1 which illustrates further the manner in which horizontal shifting of the stacked lids is retarded. For example, horizontal shifting in a direction toward or away from the foot 20*a*, as indicated by the arrow 40, is resisted primarily by the feet 20*b* and 20*c* which are angularly spaced substantially 90° from the direction of arrow 40. The other feet 20 which lie on radials which are spaced less than 90° to the direction 40 also provide resistance to horizontal shifting in the direction 40 although to a somewhat lesser extent. Thus, all or most of the feet 20 resist lateral shifting and their cumulative effect provides a stable stack.

In order to insure that each of the legs 20 on one of the lids will properly cooperate with the other lid, the flutes 24 are regularly spaced at equal intervals. As shown in FIG. 5 the pitch A between adjacent flute peaks 26 (and flute valleys 28) is substantially equal from flute to flute. The feet 20 which, in the embodiment described, are symmetrical about a radial plane 44, are disposed so that their radial planes of symmetry 44 coincide with and are in phase with the peaks 26 of the flutes of the lid. The pitch of the flutes is equal to a selected angular increment and the feet 20 are spaced from each other an angle nA which is an integer multiple of the pitch angle A. Each of the lids in the group to be stacked has the same pitch angle A for the flutes, and the feet are spaced by an angle nA that is different from lid to lid. This insures that the plane of symmetry 44 of each foot of a lid will substantially intersect the valley 28 of a trough of the next adjacent lid which will receive the foot 20.

From the foregoing it will be seen that where the feet 20 are located along radials which are in phase with flute peaks 26, none of the legs of one lid can be disposed in phase with the female depression defined by a leg on the next lower lid in the stack. This is illustrated in FIGS. 1 and 5 from which it may be seen that the nearest which a foot can come to the female side of the foot on the lower lid is a distance equal to half of the pitch angle A. A portion of the leg 20 thus will rest on the flute wall 30' where it merges into a sidewall 32 of the foot 20 on the underlying lid.

The foregoing description of the preferred embodiment of the feet and flutes is intended to primarily illustrate the principles of the invention. Other configurations for the feet projections 20 may be employed as may other flute configurations to preclude lateral shifting of the stacked lids. It is desirable that the projection engaging means be of a flute configuration, such as the flutes shown, which will enhance the lateral stiffness of the lid. This enables the flutes or other type of foot engaging means to serve the dual function of increasing lateral stiffness as well as enabling the lids to be stacked freely with improved stability.

It is also among the objects of the invention to provide a lid stacking facility in the form of projections extending from the closure wall 10 which do not project significantly into the container. This may be desirable in connection with some food products. As shown in FIG. 4, the foot 20 preferably does not extend downwardly beyond the lid skirt bead 46 which snaps under the container rim. In some instances, as in that shown in FIG. 4, it may be desirable to locate the lower extremity of the feet 20 above the bead 46. For that purpose, the closure wall 10 may include an upwardly and inwardly inclined portion 48 to raise the inner regions of the lid closure, including the foot 20. In that event, the lid would have a somewhat domed configuration.

It should be apparent that the relative dimensions of the feet and the feet engaging means are such that their cooperation is not interferred with by the nesting of the skirts 12. As shown in FIGS. 4 and 6, in the absence of any other stacking facility, the lids would nest by reason of engagement of the skirt portions 12. The feet and feet engaging means should be dimensioned so that the skirts 12 do not nest until the feet have sufficiently engaged the feet engaging means on the next lower lid. In some instances it may be desirable to select relative dimensions in which the skirts 12 remain spaced when the stacking facility is fully engaged. In other instances, as the one suggested in the drawings, the dimensions may be such that the skirts nest simultaneously with the complete engagement of the feet with the flutes. Where the skirts nest concurrently with the engagement of the stacking facility, the skirts provide a further degree of stability for the stacked lids although it should be understood that such added stability is not necessary to the invention.

While in most applications it will ordinarily be desired to employ lids in which the feed extend in the same direction from the closure wall as the skirt, i.e., downwardly toward the interior of the container, there may be some specific situation in which it may be desired to form the lid so that the feet extend in the opposite direction and project away from the container rather than into it while still embodying the principles of the invention.

Thus, I have described an improved stacking facility for thin walled thermoformed container lids which enables a plurality of such lids to be placed in a free standing stack having maximum stability. It should be understood, however, that the foregoing description of the invention is intended merely to be illustrative thereof and that other modifications may be apparent to those skilled in the art without departing from its spirit.

Having thus described the invention what I desire to claim and secure by letters Patent is:

1. A thin walled thermoformed plastic container lid comprising a generally circular closure wall having upper and lower surfaces and an integral skirt extending generally downwardly from said closure wall, a plurality of downwardly extending projections integral with said closure wall, said projections being angularly spaced about the center of said closure wall and lying within a generally annular region of said closure wall; and means in the upper surface of said annular region defining an uninterrupted series of regularly spaced projection-receiving sockets between the projections, the angle between said projections in said annular space being an integer multiple of the angle between adjacent sockets so that a pair of said lids may be stacked with the outer ends of the projections of one of said lids engaging the sockets in the other of said lids.

2. In combination, a pair of container lids as defined in claim 1, and further comprising:

one of said lids having a different number of projections thereon than the other of said lids.

3. In combination, a pair of container lids as defined in claim 1, and further comprising the angular spacing of the projections on one of said lids being different from the angular spacing of the projections on the other of said lids but the spacings in each of said lids being an integer multiple of the spacing of the sockets.

4. A lid as defined in claim 1 further comprising said skirt being of dimensions and a configuration, with respect to the dimensions and configuration of said projection such that when a pair of said lids are stacked one on top of the other the projections of one lid will engage the projection receptive sockets in the other of said lids irrespective of whether the skirt of one of said lids engages the other of said lids.

5. A container lid comprising a generally circular closure wall having upper and lower surfaces and an integral skirt extending generally downwardly from said closure wall, a plurality of projections integral with and extending away from one surface of said closure wall, said projections being angularly spaced about the center of said closure wall and lying within a generally annular region of said closure wall, means on the other surface of said closure wall and in said annular region defining a series of projection-receiving sockets said sockets being dimensioned and spaced with respect to each other and to said angular spacing of said projections so that a pair of said lids may be stacked with the outer ends of the projections of one of said lids engaging the sockets in the other of said lids;

said projection-receptive sockets comprising a plurality of radially extending flutes equiangularly spaced within said generally annular region at a predetermined pitch angle, said flutes being defined by a series of continuous sidewalls defining alternating peaks and valleys, said peaks and valleys being substantially continuous and being interrupted by said feet;

said projections being substantially symmetrical about a radial plane which is disposed angularly in phase with the pitch of said flutes.

6. A container lid as defined in claim 5 wherein said radial plane is in phase with and coincides with a radial plane extending through one of said peaks.

7. A lid as defined in claim 5 wherein each of said projections includes a pair of sidewalls, a pair of end walls and a bottom wall, said sidewalls and end walls being tapered in a direction toward the bottom wall, the angle of taper of said sidewalls being less than the angle defined by a pair of adjacent flute sidewalls which define a valley.

8. A container lid as defined in claim 7 wherein said bottom wall is of a width which is less than the pitch between adjacent flute peaks to enable the bottom wall of said foot to be received within a valley defined by a flute.

9. A container lid as defined in claim 5 further comprising:

said one surface comprising said lower surface;

each of said projections extending away from said lower surface of said closure wall a distance not substantially greater than that which said skirt extends from said closure wall.

10. A lid as defined in claim 9 further comprising:

that portion of said closure wall which is disposed between said skirt and said annular region being inclined upwardly and inwardly thereby defining a generally dome-shaped configuration for said lid.

11. A thin walled thermoformed plastic lid comprising a circular closure wall and a generally downwardly extending skirt integral with the periphery of said wall, a substantially continuous series of radially extending flutes in said closure wall equally angularly spaced about the center of the wall and lying within an annular region concentric with said wall, said flutes defining upwardly open troughs separated by peaks, and a plurality of radially and downwardly extending feet formed in said annular region interrupting certain pairs of adjacent flutes, the bottoms of said feet being in phase with the peaks of the adjacent flutes so that the angle between the bottom of a foot and an adjacent peak is the same as the angle between adjacent peaks and the angle between adjacent feet is an integer multiple of the angle between adjacent peaks.

12. A lid as defined in claim 11 further characterized by said feet having a first pair of upper downwardly converging sidewalls and a second lower pair of downwardly converging side walls, the angle of convergence of said lower pair being smaller than the angle of convergence of the upper pair of side walls, said upper pair of side walls providing seats for the bottoms of feet of the next upper lid in a stack of said lids when the feet of said lids approace alignment with one another.

* * * * *